US012235072B2

(12) United States Patent
Calvo

(10) Patent No.: US 12,235,072 B2
(45) Date of Patent: Feb. 25, 2025

(54) GARMENT FOR CARRYING A FIREARM

(71) Applicant: Summit Resource International, LLC, Bozeman, MT (US)

(72) Inventor: Tina Calvo, Windermere, FL (US)

(73) Assignee: Summit Resource International, LLC, Bozeman, MT (US)

( * ) Notice: Subject to any disclaimer, the term of this patent is extended or adjusted under 35 U.S.C. 154(b) by 348 days.

(21) Appl. No.: 17/552,253

(22) Filed: Dec. 15, 2021

(65) Prior Publication Data

US 2022/0187044 A1 Jun. 16, 2022

Related U.S. Application Data

(60) Provisional application No. 63/125,791, filed on Dec. 15, 2020.

(51) Int. Cl.

| | |
|---|---|
| ***F41C 33/04*** | (2006.01) |
| ***A41D 13/00*** | (2006.01) |
| ***F41C 33/02*** | (2006.01) |
| ***F42B 39/02*** | (2006.01) |

(52) U.S. Cl.

CPC ..... *F41C 33/048* (2013.01); *A41D 13/0007* (2013.01); *A41D 13/0012* (2013.01); *F41C 33/0227* (2013.01); *F42B 39/02* (2013.01)

(58) Field of Classification Search

CPC ..... A41D 13/0012; A41D 13/0007; F41C 33/048; F41C 33/0227; F41C 33/046

USPC ..... 2/250

See application file for complete search history.

(56) References Cited

U.S. PATENT DOCUMENTS

| | | | | |
|---|---|---|---|---|
| 1,444,750 A | | 2/1923 | Moore | |
| 1,797,359 A | * | 3/1931 | Meyers | A45C 1/04 224/602 |
| 2,992,433 A | | 7/1961 | Roberge | |
| 3,731,858 A | | 5/1973 | Baker | |
| 4,262,832 A | | 4/1981 | Perkins | |
| 4,750,652 A | * | 6/1988 | Grant | F41C 33/0236 224/579 |
| 4,750,655 A | * | 6/1988 | Barry | F41C 33/0227 224/911 |
| 5,236,113 A | * | 8/1993 | Wisser | F41C 33/0227 224/242 |
| 5,501,380 A | * | 3/1996 | Wu | F41C 33/0263 224/912 |
| 5,692,237 A | * | 12/1997 | Bennett | F41C 33/00 2/93 |
| 5,775,558 A | * | 7/1998 | Montalbano | A45F 3/14 224/675 |
| 5,991,925 A | * | 11/1999 | Wu | A41D 13/0012 224/931 |
| 6,131,198 A | | 10/2000 | Westrick | |
| 6,293,446 B1 | | 9/2001 | Nielsen | |
| 6,986,164 B1 | | 1/2006 | Morales | |
| 7,743,430 B2 | | 6/2010 | Jennings et al. | |

(Continued)

*Primary Examiner* — Jocelyn Bravo

(74) *Attorney, Agent, or Firm* — Pryor Cashman LLP

(57) ABSTRACT

A garment worn about an individual's torso that holds one or more firearms, typically in a concealed fashion. The invention may include a vest or other sleeveless outerwear that has various pockets on the exterior and one or more holsters on the interior. The invention may allow the locations and orientations of the holsters to be customized by the wearer through a hook and loop fastening system. Each holster may also include adjustable straps and quick release clasps.

18 Claims, 8 Drawing Sheets

(56) References Cited

U.S. PATENT DOCUMENTS

| | | | | |
|---|---|---|---|---|
| 8,328,058 | B2 * | 12/2012 | Wilson | A45F 3/005 224/675 |
| 8,756,716 | B2 | 6/2014 | Jordan et al. | |
| 9,370,211 | B2 | 6/2016 | Yee | |
| 9,581,413 | B2 * | 2/2017 | Massaro, Jr. | F41C 33/04 |
| 10,066,901 | B2 * | 9/2018 | Dahl | F41C 33/0236 |
| 11,747,110 | B2 * | 9/2023 | Kozak | F41C 33/048 224/183 |
| 2004/0172734 | A1 | 9/2004 | Hartbrodt | |
| 2012/0152995 | A1 * | 6/2012 | Wilson | A45F 3/005 224/587 |
| 2013/0313299 | A1 | 11/2013 | Igwenagu | |
| 2015/0144673 | A1 * | 5/2015 | Dahl | F41C 33/048 224/587 |
| 2020/0348107 | A1 * | 11/2020 | McFadden | F41C 33/0227 |

* cited by examiner

GARMENT FOR CARRYING A FIREARM

CROSS REFERENCE TO RELATED APPLICATION

This application claims the benefit of U.S. Provisional Application Ser. No. 63/125,791, filed Dec. 15, 2020, titled GARMENT FOR CARRYING A FIREARM.

FIELD

The present invention relates to a garment having compartments to hold one or more firearms. Specifically, the invention comprises a garment worn about an individual's torso, such as a vest or jacket, that may secure one or more firearms in a concealed fashion.

BACKGROUND

Various technologies are known for carrying firearms such as handguns in a concealed manner. There are individual holsters that can be worn under garments. Such holsters can be secured to a person near the waist, around a torso, or even on a leg. The holsters can be shoulder mounted, belt mounted, or strapped to a leg or ankle. A problem with these types of holsters is that the handgun is not always readily accessible depending on the garments covering the holster. For example, shirts, pants, or outerwear worn over the handgun may not be easily and quickly manipulated by a wearer to access the gun. Manufacturers have tried to address this by making garments having integrated holsters. The problem with such garments is that they lack flexibility regarding the holster configuration and size of the handgun that can be carried.

The present invention addresses these and other weaknesses in the existing concealed carry technologies by providing a highly customizable garment for carrying one or more firearms in a concealed fashion.

SUMMARY

The present invention comprises a garment worn for carrying a firearm. The garment may include an article of clothing wearable on a person's torso such as a vest or other sleeveless outerwear, a jacket, a sweatshirt, or any number of other articles of clothing. The article of clothing may have a front portion adapted to cover at least a portion of a wearer's chest and a back portion adapted to cover at least a portion of the wearer's back. The front and back portions may be joined at a shoulder portion that covers at least a portion of one shoulder of the wearer. There may be one or more panels attached to the interior surface of the front portion of the clothing, and the one or more panels may be capable of receiving and securing one or more removable holsters. A holster may be removably securable to a panel using a fastening mechanism such as a hook and loop mechanism. For example, a panel may be made from hook (or loop) material and the back of a holster may be formed from a corresponding loop (or hook) material that allow the holsters to be secured to the panels. By using hook and loop fasteners, the location and orientation of the holsters is customizable by the wearer. The holster may be secured in more than one orientation on the panel. For example, it may be oriented with a firearm in an upright position or in an angled position depending on the preference of the wearer. The holster location and orientation may be customized by the wearer.

The invention may also include one or more reinforcement members secured to the interior surface of the front portion of the clothing. The reinforcement member may include a strip of material connected to a panel and routed to the shoulder portion of the article of clothing such that it transfers at least a portion of the weight of the holster and panel to the wearer's shoulder. In one embodiment, the reinforcement member includes a piece of fabric sewn to the interior surface of the front portion of the clothing. There may also be one or more secondary reinforcement members secured to the interior surface of the back portion of the article of clothing. The invention may include pockets on the interior or exterior of the clothing such as a pocket located on an interior surface the font portion of the clothing. The pocket could have an elastic sidewall and be adapted to hold ammunition or other items.

The invention may also include a holster system for a firearm. The system may include a holster and adjustable length straps with quick release clasps to assist with retaining a firearm in the holster. For example, the holster may include a firearm receiving area, a first pocket, and a second pocket. The first and second pockets may be located on opposing sides of the firearm receiving area (e.g., the first pocket may be in front of the firearm receiving area and the second pocket may be behind the firearm receiving area). There may be two straps to help retain the firearm in the receiving area and the lengths of the straps may be adjustable. The first strap may have a first end that is securable within the first pocket and a second end that includes a fastener. The second strap may have a first end that is securable within the second pocket and a second end that includes a fastener. The fasteners on the two straps may be securable together.

A holster may also include elastic sections which allow the holster to expand as necessary. The adjustable straps and elastic sections on the holsters can accommodate firearms of different shapes and sizes, and the quick release clasps allow the weapon to be withdrawn quickly with one hand. The reinforcing members help support the weight of the guns over the shoulders of the wearer and to prevent the garment from becoming disfigured by the weight of the guns. The garment may be styled such that it can be worn by itself or worn under other garments.

DETAILED DESCRIPTION

Figure 2:
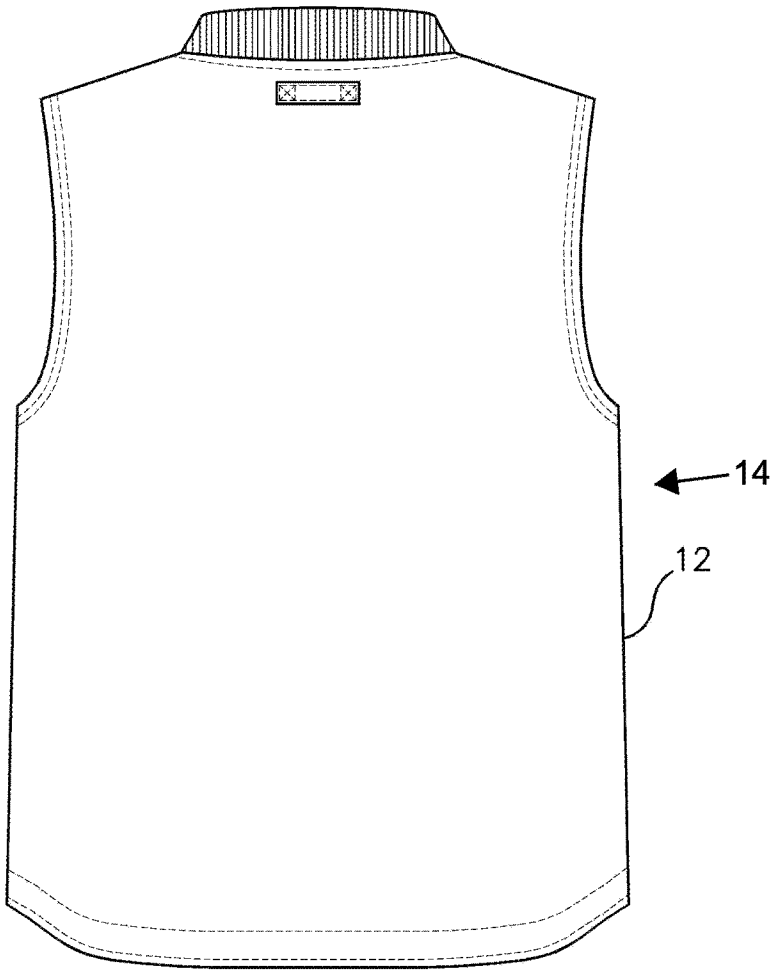
FIG. 2 is a back view of the garment of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," "leftwardly," "upper," and "lower" will refer to the installed position of the item to which the reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the figures, an exemplary embodiment of the invention comprises a garment 10 for carrying one or more firearms 11, and the firearms 11 may be carried in a concealed fashion. Garment 10 may include an article of clothing such as a vest 12 having one or more exterior breast pockets 15, one or more exterior lower pockets 20, one or more interior storage pockets 25, and one or more movable holsters 30 that are part of a customizable holster system 35.

Figure 1:
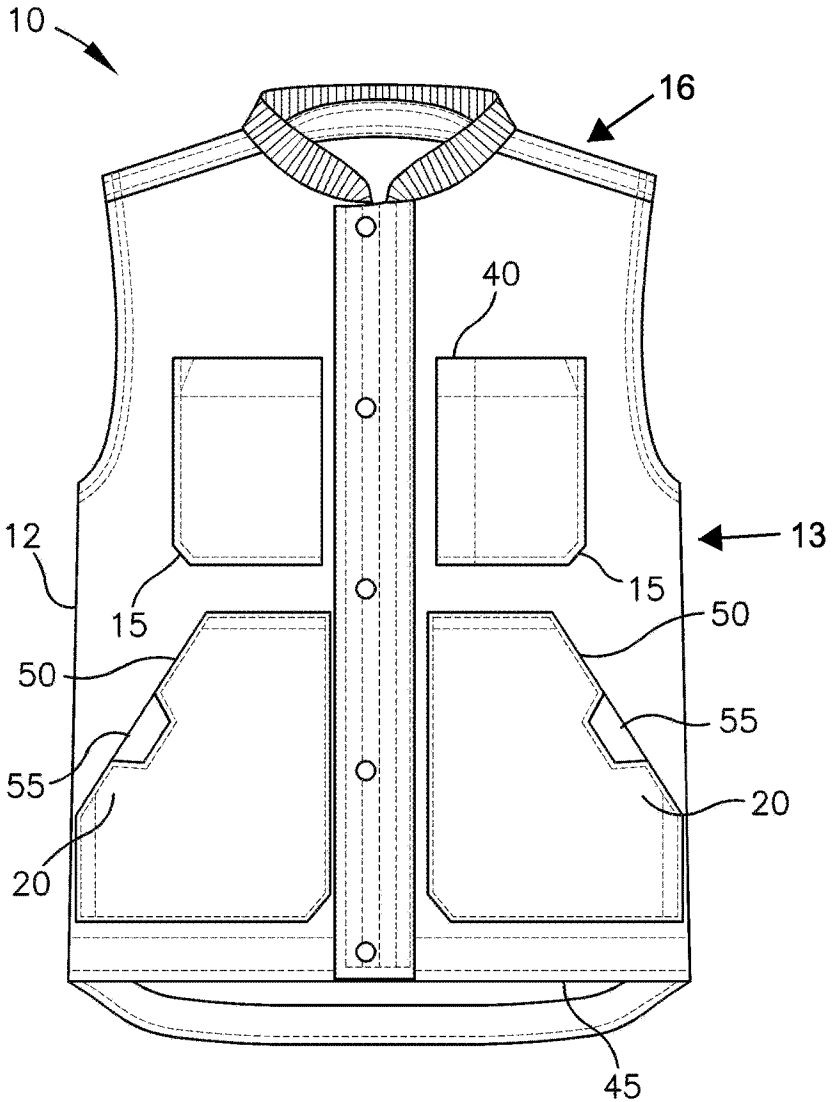
FIG. 1 is a front view of a garment for carrying a firearm.

As shown in FIG. 1, garment 10 may take the form of an article of clothing such as a vest 12 having a front portion 13, a back portion 14, and a shoulder portion 16. Vest 12 may have one or more breast pockets 15 on the exterior of the front portion 13 of the vest proximate the chest of the wearer. Breast pocket 15 may take any number of forms including a patch style or flap style. It may include one or more sub-pockets such as a pencil pocket 40, which can be formed by stitching or otherwise creating a divider between the main pocket and the sub-pocket.

Vest 12 may also include one or more lower pockets 20 on the exterior of the front portion 13 of the vest proximate a lower hem 45. Lower pocket 20 may take any number of forms including a patch style of flap style. The opening 50 of lower pocket 20 may be located such that a wearer can easily place a hand in the pocket. Lower pocket 20 may be large enough to receive a hand and/or store items such as gloves or other personal items. Pocket 20 may have a closure or fastener 55 (e.g., snap, button, zipper, hook and loop, buckle) that allows opening 50 to be securely closed.

Figure 3:
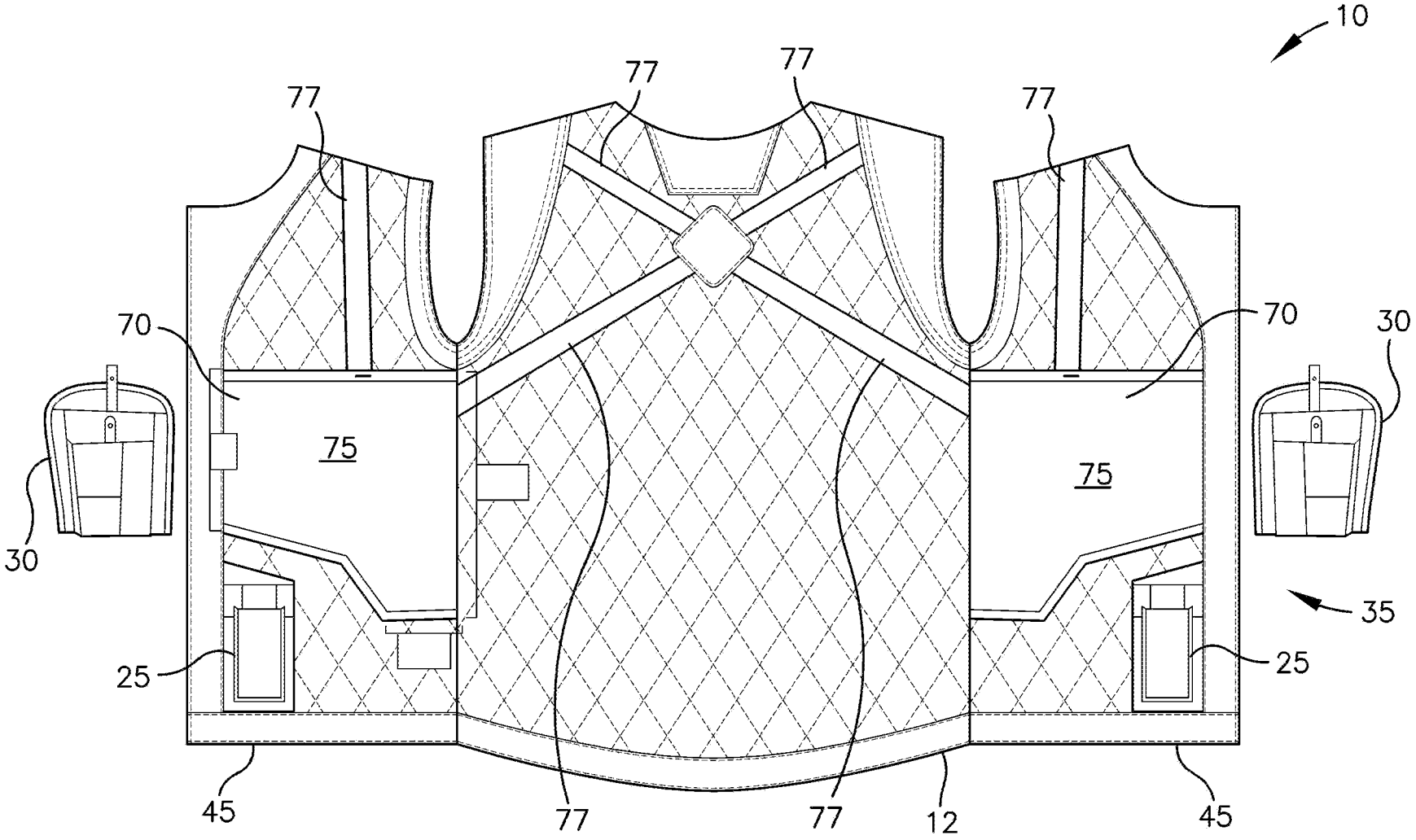
FIG. 3 is a view of the interior of the garment of FIG. 1 with the shoulder seams removed so that the garment can be laid flat.
Figure 8A:
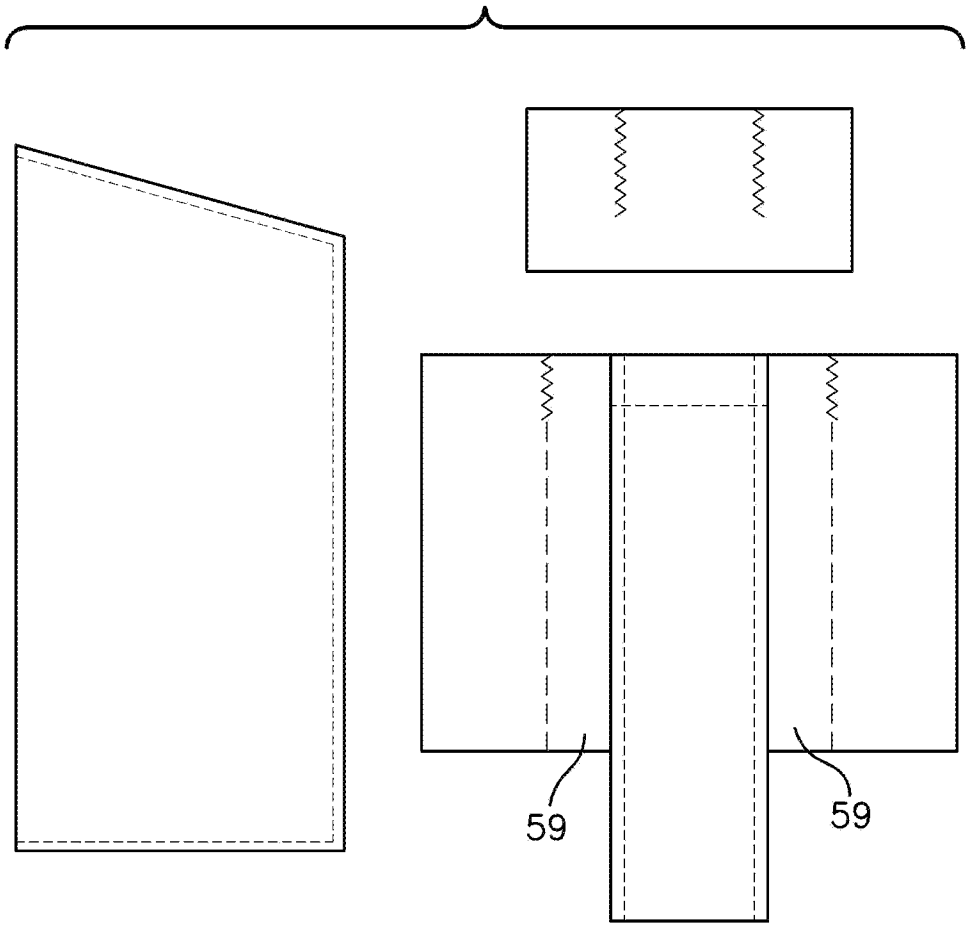
FIG. 8A is an exploded view of the components of the expandable pocket of FIG. 8.
Figure 8:
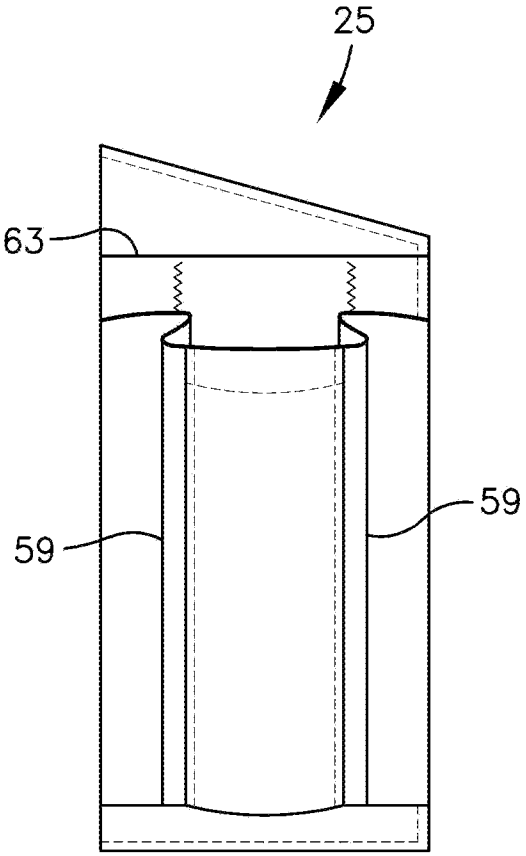
FIG. 8 is an enlarged view of an expandable pocket for the garment of FIG. 1.

As shown in FIG. 3, there may be one or more storage pockets 25 located on the interior of vest 12. Like the other pockets on vest 12, storage pocket 25 may take any number of forms including patch style or flap style. As best seen in FIG. 8, storage pocket 25 may have one or more elastic sidewalls 59 that allow the pocket to expand in size. Any number of items may be stored in any of the pockets on vest 12, however the interior storage pockets 25 may be well adapted to store ammunition, clips, or other ancillary items associated with firearm 11. The elastic sidewalls 59 allow the pocket 25 to expand and contract as necessary to hold items of different sizes. Because of its elastic sidewalls 59, pocket 25 can securely hold one or more items with a friction fit as the sidewalls 59 contract to conform to the items. There may also be one or more sub-pockets 63 made from elastic or other material located next to or otherwise proximate pocket 25 to assist with retaining items in pocket 25. Interior storage pocket 25 may be at various locations on the interior of vest 12, and in one embodiment it may be located near the bottom of the vest proximate lower hem 45. Storage pocket 25 may also include a closure or fastener (e.g., snap, button, zipper, hook and loop, buckle) that allows the pocket to be securely closed.

Figure 4:
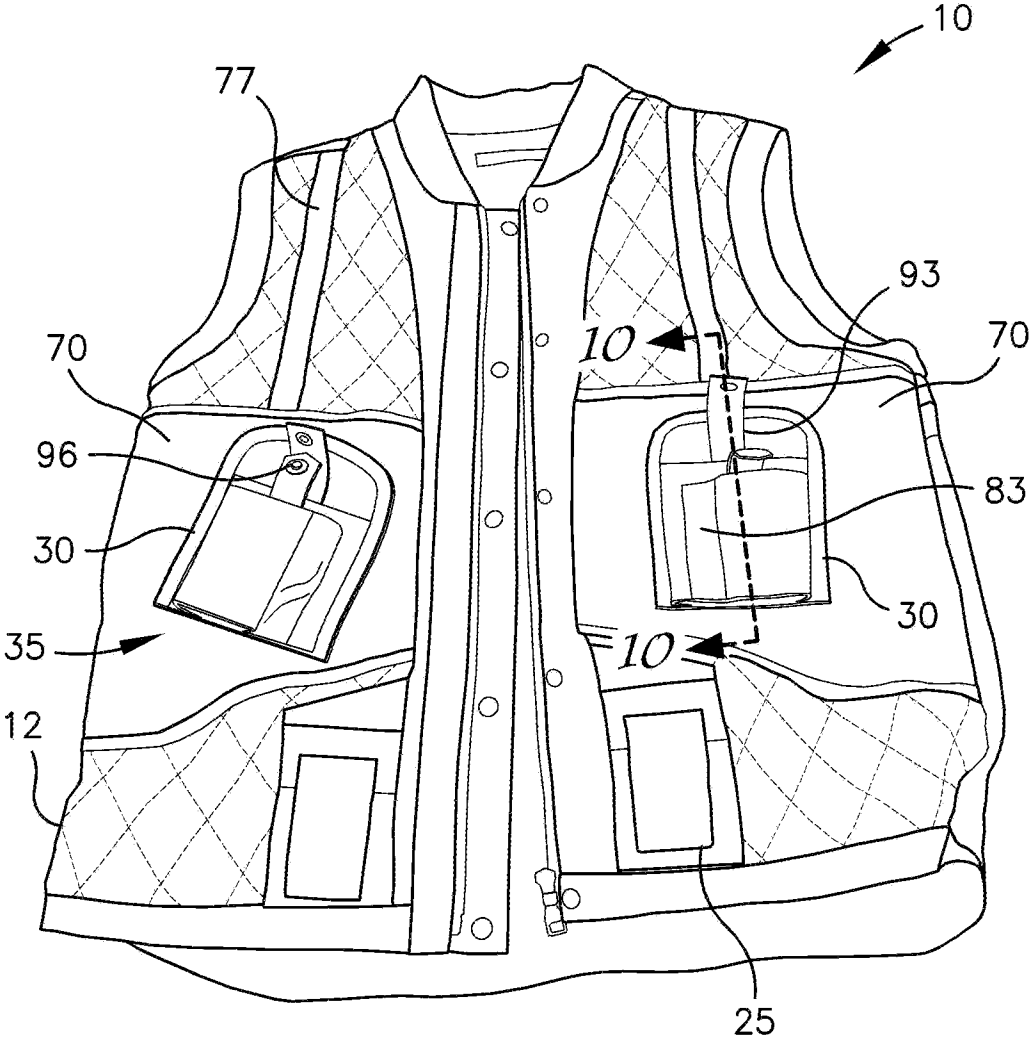
FIG. 4 is a view of the garment of FIG. 1 turned inside out such that the interior of the garment is visible.

As best seen in FIGS. 3 and 4, vest 12 may include a holster system 35 that allows holsters 30 to be located and oriented on the vest 12 as desired by the wearer. Holster system 35 may include one or more panels 70 comprising hook (or loop) material that are located on the interior surface of the front portion 13 of vest 12 proximate a wearer's stomach and/or chest. Each panel 70 is adapted to receive one or more holsters 30 having a corresponding loop (or hook) material mateable with the panel 70. It is foreseen that fastening means other than hook and loop may also be used to secure holster 30 to panel 70 including snaps, buttons, adhesive, zipper, and clamps. The exact size and location of each panel 70 will depend on the particular application, however the panels 70 will typically be large enough to receive a holster for a handgun. Panels 70 may be considered as defining a holster zone 75, wherein a holster 30 may be attached to vest 12 anywhere within the holster zone 75 by securing the mateable portion of the holster 30 with panel 70. Vest 12 may include panels 70 located on each side of the central vertical opening or placket of the vest 12.

Figure 5:
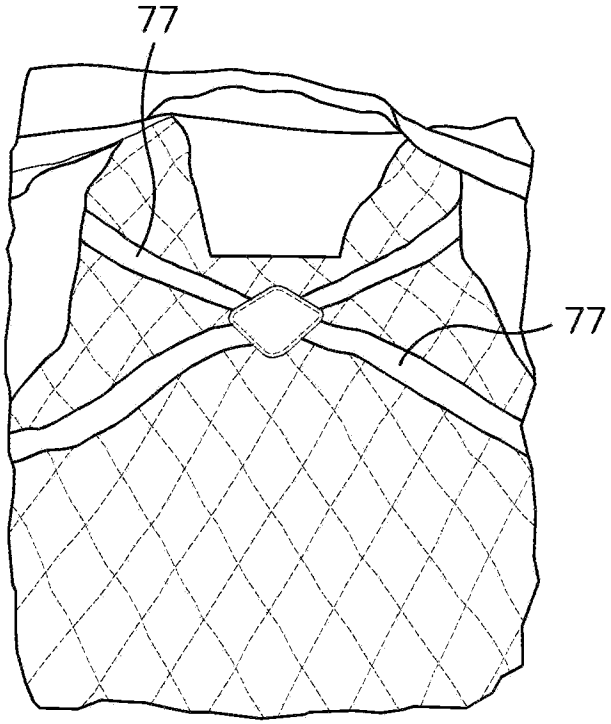
FIG. 5 is an enlarged partial view of the interior of the garment of FIG. 1.

As best seen in FIGS. 3 and 5, holster system 35 may include reinforcing members 77 formed in the vest 12 to help support the weight of a holstered firearm 11 secured to panel 70. Reinforcing member 77 may take the form of woven taping stitched into the vest 12 and arranged to transfer at least a portion of the weight of firearm 11 to a wearer's shoulders such that the weight is distributed relatively equally over the shoulders. This transfer and distribution of weight helps keep the vest from becoming disfigured or unbalanced on the wearer. Reinforcing members 77 may be arranged in any number of configurations that allow weight to be distributed. In one embodiment, the reinforcing members 77 may extend from a panel 70 to first and second portions of the shoulder portion 16 of vest 12 (where the front portion 13 and back portion 14 of the vest are joined and cover at least a portion of the wearer's shoulders), such that the reinforcing members 77 are not directly connected to one another at the shoulder portion 16. The reinforcing members 77 may crisscross the back portion 14 of the vest 12 and/or extend from a panel to a wearer's shoulders across the breast portion of the best 12 as shown in FIG. 3.

Figure 6A:
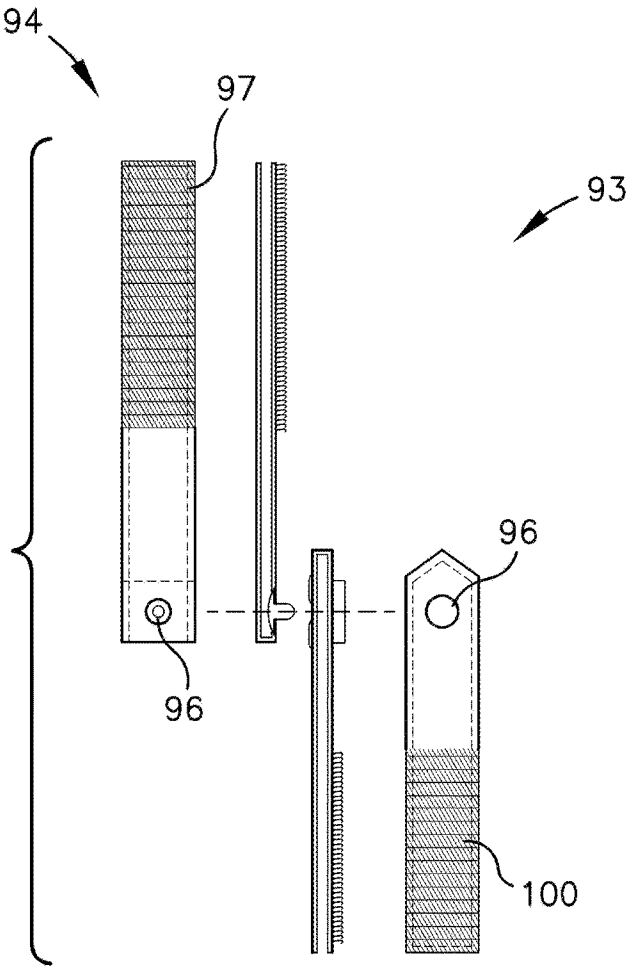
FIG. 6A is an exploded view of the straps for the holster of FIG. 6.
Figure 6:
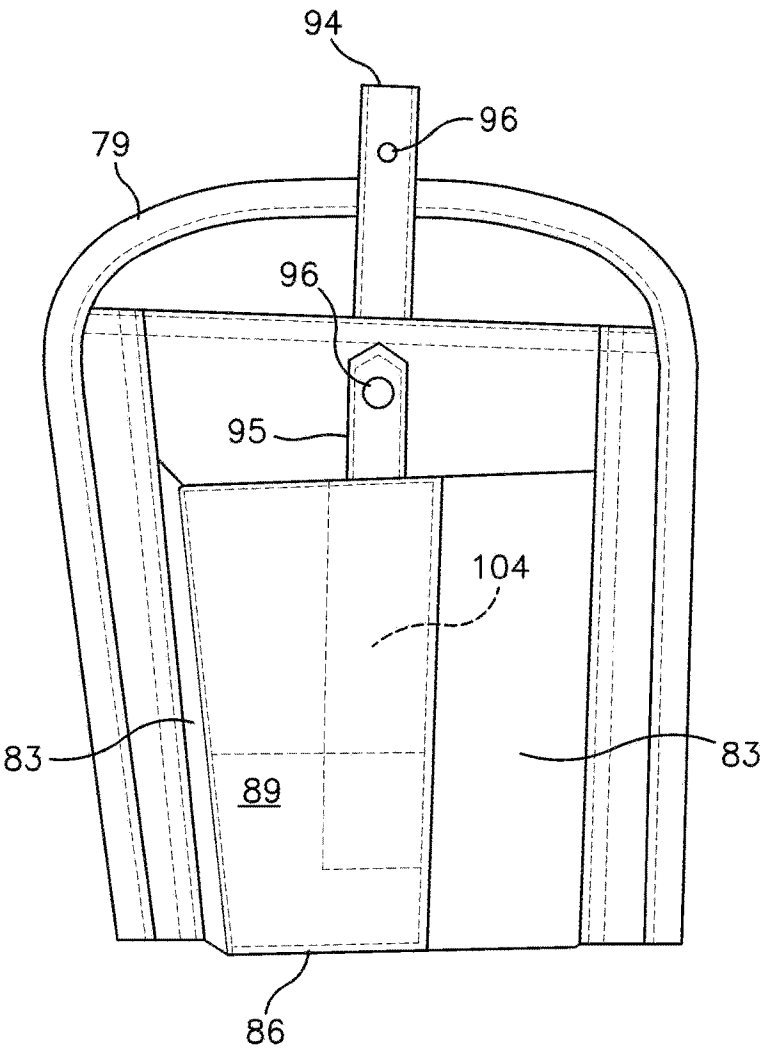
FIG. 6 is an enlarged view of a holster for the garment of FIG. 1.
Figure 7:
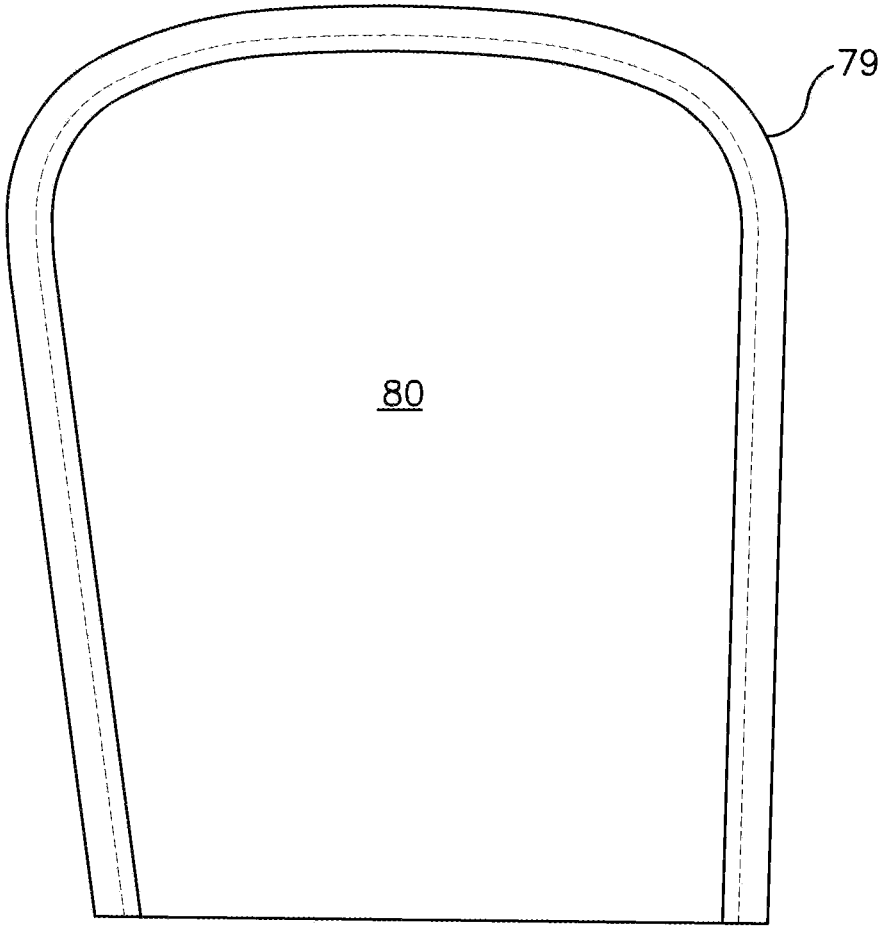
FIG. 7 is a back view of the holster of FIG. 6.
Figure 9B:
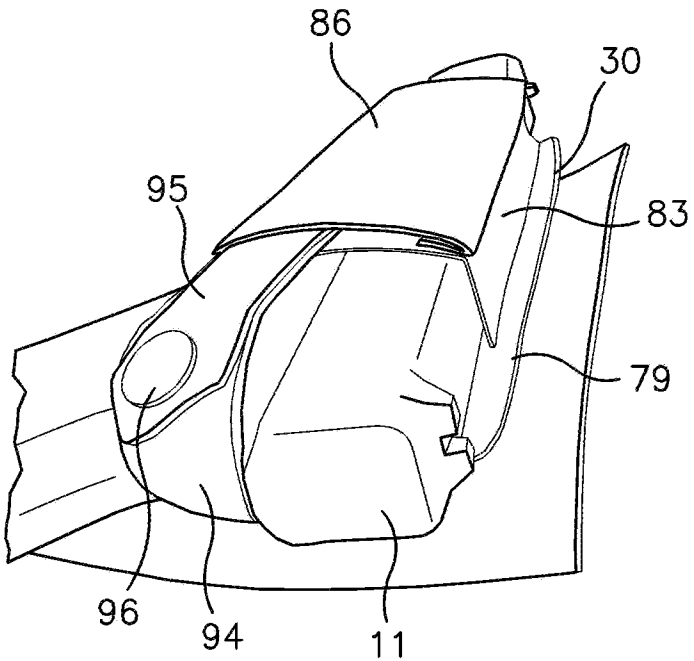
FIG. 9B is an alternate top partial perspective view of the holster and firearm of FIG. 9.
Figure 9A:
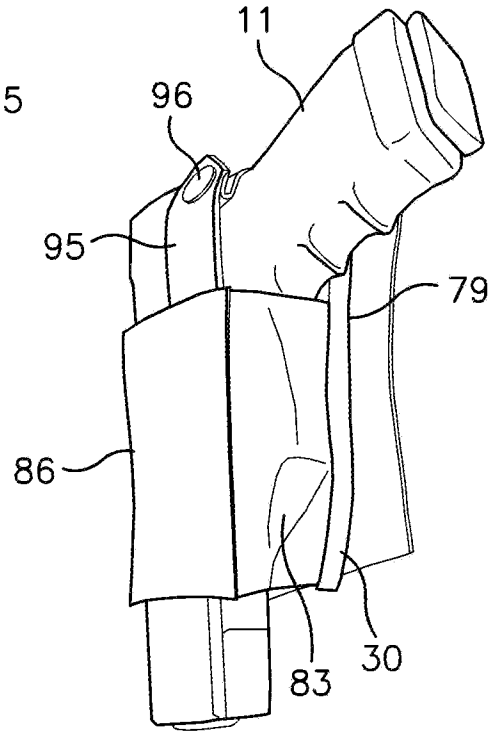
FIG. 9A is an alternate front partial perspective view of the holster and firearm of FIG. 9.
Figure 9:
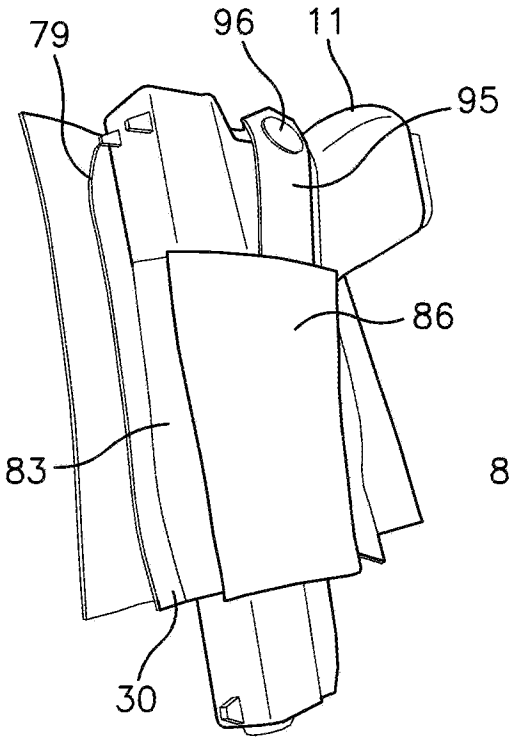
FIG. 9 is a front partial perspective view of firearm secured within a holster.

As shown in FIGS. 6, 7 and 9, and as described above, holster 30 may include a back portion 79 having a rearward facing loop (or hook) material 80 mateable with panel 70. Back 79 may be relatively planar to maximize the amount of loop (or hook) material that contacts panel 70. Attached to the back portion 79 of holster 30 are elastic sidewalls 83 that allow the holster 30 to expand in size as necessary to carry firearms of different sizes. Each sidewall 83 may be formed from a single piece of material or there may be multiple members adjacent one another (e.g., multiple elastic members) thus collectively forming a sidewall 83. Sidewalls 83 may extend from the back portion 79 to a front portion 86 of holster 30. Front portion 86 may include a front panel 89. The space between front panel 89 and back portion 79 may be considered the firearm receiving area 102 in which at least a portion of firearm 11 may be placed when carried on vest 12.

Holster 30 may also include straps 93 for retaining firearm 11 in the holster 30. Straps 93 may by attached to holster 30 and wrap around firearm 11 in any number of configurations. In one embodiment, straps 93 are attached to the back and front portions (79 and 86) of holster 30 such that the straps 93 may be secured over firearm 11 thus keeping it in holster 30. More specifically, there may be a back strap 94 and a front strap 95, wherein the back strap 94 attaches to the back portion 79 of holster 30 and the front strap 95 attaches to the front portion 86 of holster 30. The distal ends of straps 94 and 95 may have corresponding fasteners 96 (such as a snap or hook and loop) so that the straps can be secured together over the top of firearm 11. Either or both of strap 94 and strap 95 may be adjustable in length, which allows them to be elongated or shortened as necessary to snuggly fit over the top of firearm 11.

Figure 10:
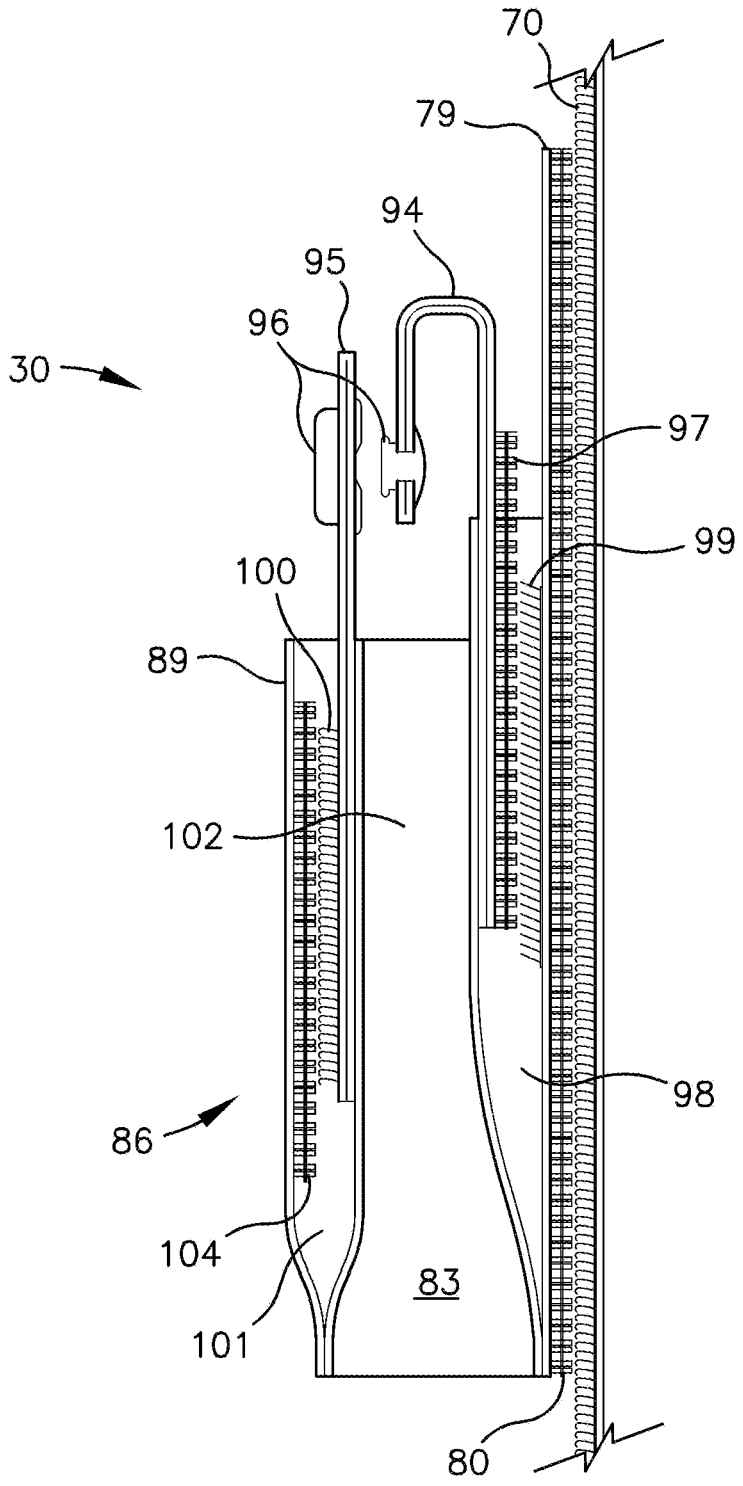
FIG. 10 is a partial section view of a holster taken along line 10-10 of FIG. 4.

As best seen in FIGS. 6 and 10, the lengths of straps 94 and 95 may adjusted using a hook and loop positioning system. The portions of the straps attached to holster 30 may include hook (or loop) material, which can fasten to a corresponding loop (or hook) material on holster 30. With respect to back strap 94, there may be a pad 97 of hook (or loop) material on the front or back (or both) of the strap 94. Pad 97 may then be secured to a corresponding loop (or hook) member 99 on the back portion 79 of holster 30. Member 99 may be attached to the front or back of the back portion 79, or it may be placed in a pocket 98 on back portion 79 adapted to receive strap 94. In one embodiment, pad 97 on strap 94 may even be fastened to the panel 70 by sliding strap 94 through an opening in back 79 so that it is positioned between back 79 and panel 70.

Similarly, with respect to front strap 95, there may be a pad 100 of hook (or loop) material on the front or back (or both) of the strap 95. Pad 100 may then be secured to a corresponding loop (or hook) member 104 on the front portion 86 of holster 30. Member 104 may be attached to the front or back of the front panel 89, or it may be placed in a pocket 101 on front portion 86 adapted to receive strap 95.

To use holster system 35, a firearm 11 may be placed in holster 30 and then holster 30 secured to panel 70 in the desired location and orientation. Alternatively, holster 30 may first be secured to panel 70 in the desired location and orientation and then firearm 11 placed in the holster 30. As noted above, holster 30 utilizes elastic sidewalls 83 which allow it to hold firearms 11 of different shapes and sizes. Once firearm 11 is positioned in holster 30, the lengths of straps 94 and 95 may be adjusted as necessary. The lengths of the straps are such that when straps 94 and 95 are fastened over firearm 11, they are relatively taut and minimize movement of the firearm within holster 30. Straps 94 and 95 may be fastened together by engaging a fastener 96 on one strap with a corresponding fastener 96 on the other strap. Fastener 96 may be a snap or clasp that can be easily and quickly disengaged with one hand, thereby allowing firearm 11 to also be withdrawn from holster 30 easily and quickly with one hand. For example, fastener 96 could be a snap that can be disengaged using a single upward or downward thumb motion. It is foreseen that holster 30 could also be used to carry other weapons such as knives or non-lethal weapons.

Other features that vest 12 may include are a ribbed collar with partial collar stand, zipper and/or snap fasteners on the central vertical opening for the vest, a hanging loop on the back of the vest, and bottom hem that is lower in the back than the front of the vest.

It is to be understood that while certain forms of the present invention have been illustrated and described herein, it is not to be limited to the specific forms or arrangement of parts described and shown.

Having thus described the invention, what is claimed as new and desired to be secured by Letters Patent is as follows:

1. A garment for carrying a firearm, said garment comprising:

an article of clothing wearable on a wearer's torso, said article of clothing having a front portion and a back portion wherein said front portion is adapted to cover at least a portion of the wearer's chest and said back portion is adapted to cover at least a portion of the wearer's back, said front portion and said back portion joined at a shoulder portion that is adapted to cover at least a portion of a shoulder of the wearer;

a holster that is removably securable to said article of clothing;

a panel on an interior surface of said front portion of said article of clothing, said panel having a fastening mechanism adapted to secure said holster to said panel, said fastening mechanism allowing said holster to be secured in more than one orientation on said panel;

a first reinforcement member secured to the interior surface of said front portion of said article of clothing, said first reinforcement member comprising a strip of material connected to said panel and routed to said shoulder portion of said article of clothing, said first reinforcement member adapted to transfer at least a portion of the weight of said holster and said panel to the wearer's shoulder; and a second reinforcement member secured to and crisscrossing an interior surface of said back portion of said article of clothing, wherein said first reinforcement member is connected to a first portion of said shoulder portion, said second reinforcement member is connected to a second portion of said shoulder portion, the second portion of said shoulder portion being different from the first portion of said shoulder portion such that the first reinforcement member and the second reinforcement member are not directly connected to one another.

2. The garment of claim 1, wherein said fastening mechanism on said panel includes a hook and loop mechanism.

3. The garment of claim 2, wherein said first reinforcement member includes a piece of fabric sewn to the interior surface of said front portion of said article of clothing.

4. The garment of claim 3, further comprising a pocket located on said interior surface of said front portion of said article of clothing.

5. The garment of claim 4, wherein said pocket has an elastic sidewall.

6. The garment of claim 5, wherein said pocket is adapted to hold ammunition.

7. The garment of claim 6, wherein said article of clothing comprises sleeveless outerwear.

8. A holster system for a firearm, said holster system comprising:

a holster having a firearm receiving area, a first pocket, and a second pocket, wherein said first pocket and said second pocket are located on opposing sides of said firearm receiving area;

a first strap adapted to retain a firearm in said firearm receiving area, wherein a first end of said first strap is securable within said first pocket and a second end of said first strap includes a first fastener;

a second strap adapted to retain the firearm in said firearm receiving area, wherein a first end of said second strap is securable within said second pocket and a second end of said second strap includes a second fastener, wherein said first fastener is securable to said second fastener;

a panel on an interior surface of an article of clothing, said panel having a fastening mechanism adapted to removably secure said holster to said panel, said fastening mechanism allowing said holster to be secured in more than one orientation on said panel;

a first reinforcement member secured to the interior surface of said article of clothing; and a second reinforcement member secured to and crisscrossing the interior surface of said article of clothing, wherein said first reinforcement member is connected to a first portion of a shoulder portion of the article of clothing, said second reinforcement member is connected to a second portion of said shoulder portion, the second portion of said shoulder portion being different from the first portion of said shoulder portion such that the first reinforcement member and the second reinforcement member are not directly connected to one another.

9. The holster system of claim 8, wherein said fastening mechanism on said panel includes a hook and loop mechanism.

10. The holster system of claim 9, wherein said first reinforcement member comprises a strip of material connected to said panel and routed to said first portion of said shoulder portion of the article of clothing.

11. The holster system of claim 10, wherein said article of clothing comprises sleeveless outerwear.

12. A garment for carrying a firearm, said garment comprising:

an article of clothing wearable on a wearer's torso, said article of clothing having a front portion and a back portion wherein said front portion is adapted to cover at least a portion of the wearer's chest and said back portion is adapted to cover at least a portion of the wearer's back, said front portion and said back portion joined at a shoulder portion that is adapted to cover at least a portion of a shoulder of the wearer;

a holster that is removably securable to said article of clothing, said holster having a firearm receiving area, a first pocket, and a second pocket, wherein said first pocket and said second pocket are located on opposing sides of said firearm receiving area;

a first strap adapted to retain a firearm in said firearm receiving area, wherein a first end of said first strap is securable within said first pocket and a second end of said first strap includes a first fastener;

a second strap adapted to retain the firearm in said firearm receiving area, wherein a first end of said second strap is securable within said second pocket and a second end of said second strap includes a second fastener, wherein said first fastener is securable to said second fastener;

a panel on an interior surface of said front portion of said article of clothing, said panel having a fastening mechanism adapted to secure said holster to said panel, said fastening mechanism allowing said holster to be secured in more than one orientation on said panel;

a first reinforcement member secured to the interior surface of said front portion of said article of clothing, said first reinforcement member comprising a strip of material connected to said panel and routed to said shoulder portion of said article of clothing, said first reinforcement member adapted to transfer at least a portion of the weight of said holster and said panel to the wearer's shoulder; and a second reinforcement member secured to and crisscrossing an interior surface of said back portion of said article of clothing, wherein said first reinforcement member is connected to a first portion of said shoulder portion, said second reinforcement member is connected to a second portion of said shoulder portion, the second portion of said shoulder portion being different from the first portion of said shoulder portion such that the first reinforcement member and the second reinforcement member are not directly connected to one another.

13. The garment of claim 12, wherein said fastening mechanism on said panel includes a hook and loop mechanism.

14. The garment of claim 13, wherein said first reinforcement member includes a piece of fabric sewn to the interior surface of said front portion of said article of clothing.

15. The garment of claim 14, further comprising a pocket located on said interior surface of said front portion of said article of clothing.

16. The garment of claim 15, wherein said pocket has an elastic sidewall.

17. The garment of claim 16, wherein said pocket is adapted to hold ammunition.

18. The garment of claim 17, wherein said article of clothing comprises sleeveless outerwear.

* * * * *